United States Patent [19]

Whitaker, Jr.

[11] Patent Number: 4,705,115

[45] Date of Patent: Nov. 10, 1987

[54] METHOD AND APPARATUS FOR RECONDITIONING BALLAST ALONG A RAILROAD TRACK

[75] Inventor: John B. Whitaker, Jr., Wetumpka, Ala.

[73] Assignee: Kershaw Manufacturing Company, Inc., Montgomery, Ala.

[21] Appl. No.: 846,021

[22] Filed: Mar. 31, 1986

[51] Int. Cl.[3] ..... E01B 27/02

[52] U.S. Cl. ..... 171/16; 37/105; 104/2; 104/7.3

[58] Field of Search ..... 37/104, 105, 106, 107, 37/195; 171/16; 104/2, 7.3

[56] References Cited

U.S. PATENT DOCUMENTS

| | | | |
|---|---|---|---|
| 1,698,529 | 1/1929 | Bennett | 37/195 |
| 2,145,763 | 1/1939 | Gill | 171/16 |
| 2,775,438 | 12/1956 | Bach et al. | 171/16 X |
| 4,042,035 | 8/1977 | Boyer | 171/16 |
| 4,257,331 | 3/1981 | Theurer et al. | 171/16 X |
| 4,534,415 | 8/1985 | Theurer et al. | 171/16 |
| 4,563,826 | 1/1986 | Whitaker, Jr. | 37/104 X |

*Primary Examiner*—Edgar S. Burr
*Assistant Examiner*—Moshe I. Cohen
*Attorney, Agent, or Firm*—Jennings, Carter, Thompson & Veal

[57] ABSTRACT

A method and apparatus for reconditioning ballast along a railroad track utilizes lateral excavators to excavate the ballast adjacent the track ahead of an undercutter which excavates beneath the track. The ballast from adjacent the track is discharged below the track without processing, while the ballast taken from beneath the track is processed by a cleaning screen to recover reuseable ballast which is discharged outwardly of the center of the track.

14 Claims, 9 Drawing Figures

METHOD AND APPARATUS FOR RECONDITIONING BALLAST ALONG A RAILROAD TRACK

FIELD OF THE INVENTION

The present invention relates generally to the field of railroad maintenance and particularly to a method and apparatus for reconditioning ballast used as the roadbed for a railroad track. More particularly, the invention relates to reconditioning the ballast at a relatively high rate of speed by separately removing a portion of the ballast which is less susceptible to contamination or deterioration, removing the remainder of the ballast and replacing the remainder with the first removed portion, then replacing the first removed portion with reuseable ballast recovered from the remainder.

BACKGROUND OF THE INVENTION

As is well known the ballast forming the roadbed of a railway track is susceptible to contamination and deterioration caused by the passage of trains over the track. In some areas the ballast must be reconditioned at least annually. There are numerous forms of apparatus which have been developed for this task. Typical apparatus which are used for this type operation include track undercutters to remove the ballast from beneath the tracks, ditcher wheels to remove ballast from areas alongside the tracks and cleaning screens to recover reuseable ballast from the ballast removed by the undercutters and ditcher wheels.

It will be appreciated that the rail lines which require the most frequent maintenance are the busiest lines, therefore the time available during which the tracks may be blocked by apparatus reconditioning the ballast is quite limited. Therefore it is imperative that the reconditioning proceed as rapidly as possible. Typical ditcher wheels may remove ballast from alongside the tracks at speeds up to 5,000 feet per hour and typical undercutters may operate at slightly reduced speeds. However when the ballast from the undercutter and ditcher wheels are fed to a cleaning screen, the rate of progress is limited by the capacity of the screen. Typical screen capacity limits the forward rate of travel in such instances to about 1,000 feet per hour. The shortcomings of such machines are well known and are fully discussed in U.S. Pat. No. 4,534,415. U.S. Pat. No. 4,534,415 purports to improve the speed of the operation by providing a further ballast screening installation, mounted on the apparatus frame, which may thus effectively double the capacity of the cleaning system. While such an apparatus seems suitable for its intended purpose, it leaves something to be desired in terms of economy and efficiency in that the apparatus is appreciably more complex than the instant invention.

SUMMARY OF THE INVENTION

It is the object of the present invention to provide a method and apparatus for reconditioning the ballast along a track at a substantially higher speed than heretofore possible with a single screen ballast cleaner.

The object of the invention is accomplished through the use of a conventional ditcher wheel for removing ballast from adjacent the sides of the track and a conventional undercutter for removing ballast from beneath the track. Since the ballast removed by the ditcher wheel is generally cleaner than the ballast underlying the track, this ballast is transported rearwardly of the undercutter and discharged onto the center of the track to replace the ballast removed by the undercutter. Thus the ballast removed by the undercutter is the only ballast which is processed by a cleaning screen whereby the apparatus may move more rapidly. If the ballast alongside the track is too dirty to be transferred to the center of the track, a separate ditcher machine may be used to remove and replace the ballast alongside the track. Such machines move more rapidly than the undercutter device, thus the process is not impeded by the replacement of the ballast along the shoulder.

BRIEF DESCRIPTION OF THE DRAWING

Apparatus embodying features of my invention are depicted in the accompanying drawings which form a portion of this application and wherein.

Description of a Preferred Embodiment

Figure 1:
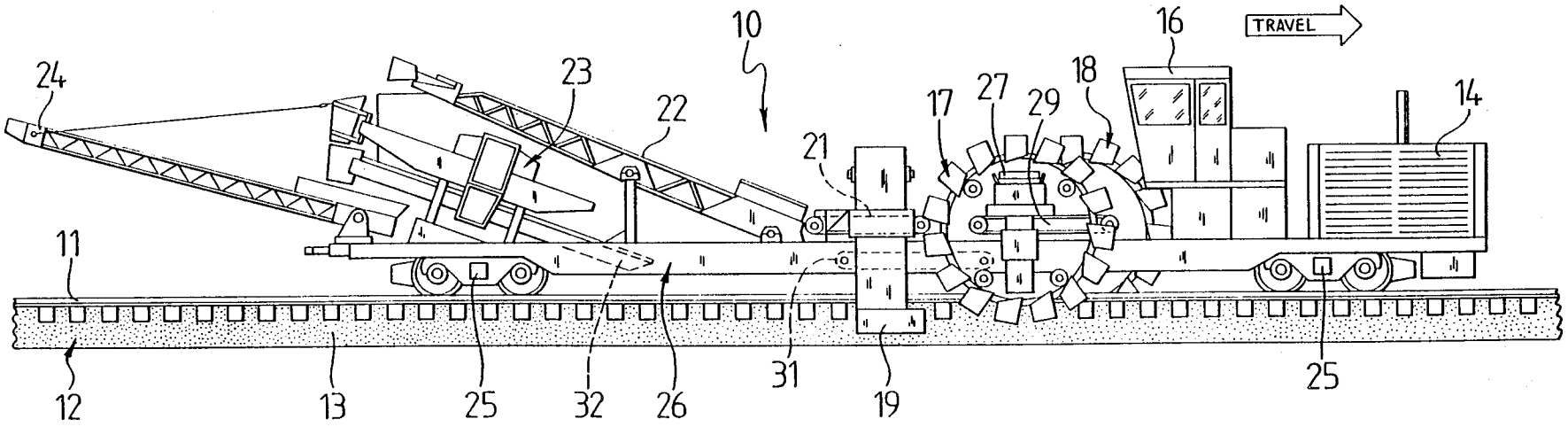
FIG. 1 is a side elevational view showing my improved ballast reconditioning apparatus.

Referring to FIG. 1, a ballast reconditioner 10 is shown on a track 11 which in turn is supported on a bed 12 of ballast 13. The reconditioner 10 includes a power unit 14 which propels the reconditioner 10 and drives the various components. A cab 16 is provided for the operator and provides conventional control connections to enable operation of the apparatus. Rearward of the cab 16 is a set of ditcher wheels 17 and 18 which excavate ballast from along the side of the track 11. An undercutter 19 is mounted rearwardly of the ditcher wheels and operates conventionally to remove ballast from beneath the tracks 11 to a pair of conveyors 21 and 22 which transfer the ballast from the undercutter 19 to a conventional ballast screen cleaner 23. The cleaner 23 recovers reuseable ballast and discharges unuseable residue through a waste conveyor 24. The reconditioner 10 has a frame 26 which is supported on a pair of carriages 25 and which supports all of the above mentioned elements.

Figure 2:
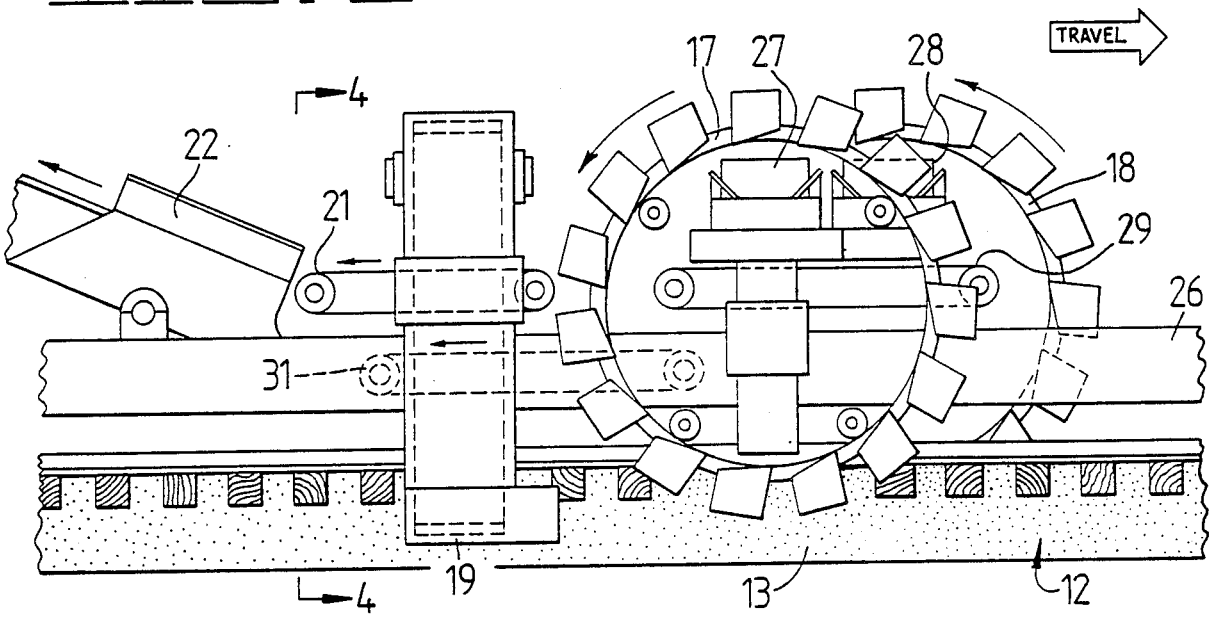
FIG. 2 is a fragmental diagrammatic side elevational view showing the by-pass conveyor in relation to the undercutter.
Figure 3:
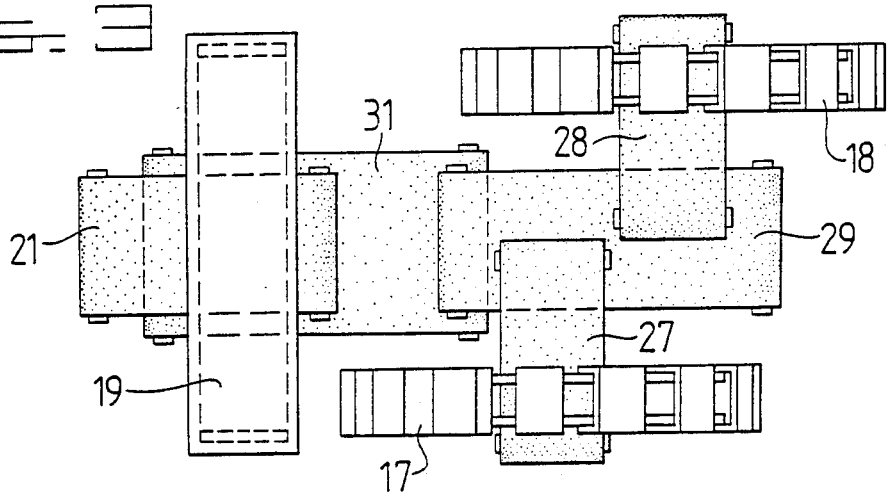
FIG. 3 is a diagrammatic plan view of the portion of the apparatus shown in FIG. 2.
Figure 4:
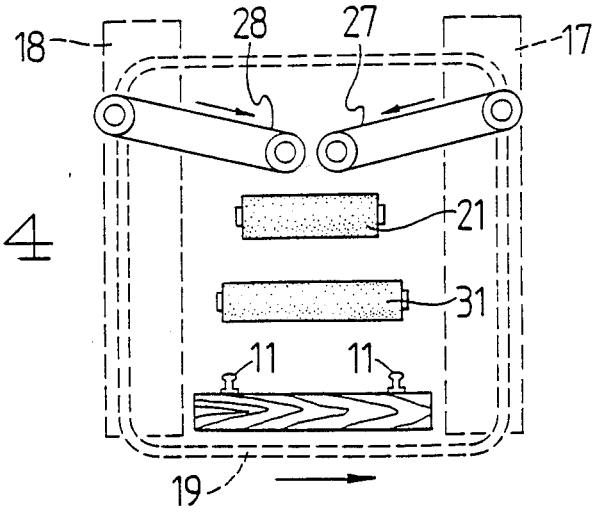
FIG. 4 is a diagrammatic sectional view taken along line 4—4 of FIG. 2; and, FIGS. *5a–e* are a pictorial depiction of the railroad bed during the reconditioning process.

As is more clearly shown in FIGS. 2 and 3, the ditcher wheels 17 and 18 are provided with conventional cross conveyors 27 and 28, respectively, which are positioned to receive ballast from the respective ditcher wheels and to discharge the ballast along the center of the reconditioner 10. Along the center of the reconditioner 10 is a forward conveyor 29 which extends parallel to the track 11 between ditcher wheels 17 and 18 which receives ballast from the cross conveyors 27 and 28. Forward conveyor 29 terminates forward of the undercutter 19 and discharges the ballast carried therein onto a by-pass conveyor 31 which extends parallel to the track 11 beneath the conveyor 21, as shown in FIG. 4, to a point intermediate the undercutter 19 and the cleaner 23. Thus ballast carried by by-pass conveyor 31 is discharged rearwardly of the undercutter 19 along the center of the track 11.

As the reconditioner 10 moves along the track in the direction of the arrow, the undercutter 19 removes ballast from beneath the track 11. This ballast is carried to the cleaner 23 and conventionally cleaned. The cleaner 23 is provided with a clean ballast return 32 which discharges reuseable ballast along the track outwardly of the center thereof.

Figure 5A:
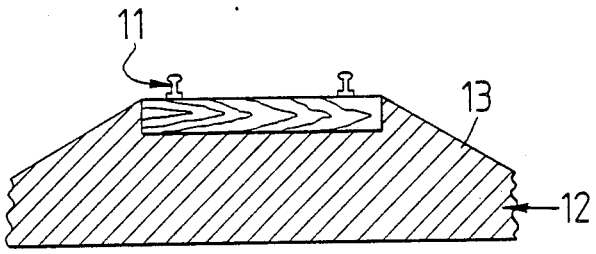
Figure 5B:
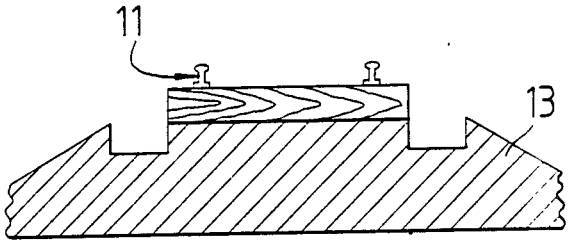
Figure 5C:
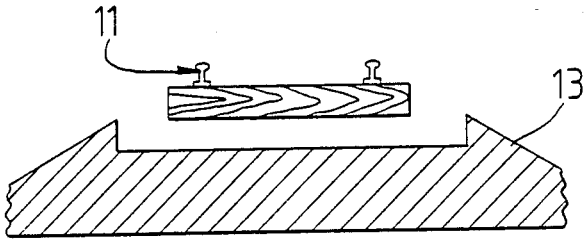
Figure 5D:
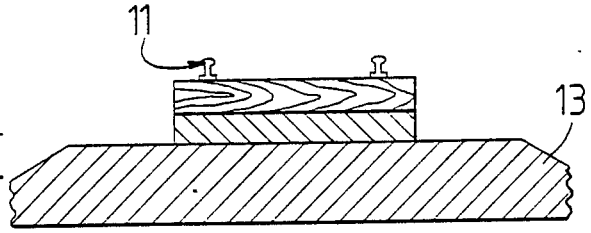
Figure 5E:
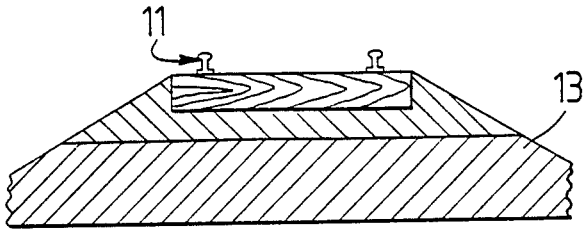

The operation of the reconditioner may be more clearly understood with reference to FIGS. 5*a*–5*e*. FIG. 5*a* represents the cross section of the ballast 13 along the track 11 prior to any removal steps. The ditcher wheels remove the shoulders of the ballast 13 adjacent the ends of the crossties, as shown in FIG. 5*b*. The undercutter then removes the ballast directly under the track as shown in FIG. 5*c*. The ballast previously removed by the ditcher wheels is discharged into the center of the track, as shown in FIG. 5*d*, and recovered ballast from the cleaner is discharged outwardly of the center of the track, as shown in FIG. 5*e*. It will be understood that fresh ballast may be added to the recovered ballast and conventional sweepers and tampers will be used to return the ballast to its normal profile and consistency. Additionally it will be understood that it will at some time be necessary to clean or replace the ballast lying along the shoulders of the railroad bed. This may be accomplished by excavating the sides of the track ahead of the reconditioner 10 and cleaning or replacing the ballast prior to operating the reconditioner 10. Thus, the reconditioner 10 would transfer the fresh or cleaned ballast to the center of the track 11 and place the recovered ballast along the sides of the track such that it would be cleaned or replaced during the next maintenance cycle.

Thus it may be seen that the volume of ballast directed to the cleaner 23 during operation of the reconditioner will be only about forty to fifty percent of the volume conventionally directed to the cleaner 23. Therefore the reconditioner can move along the track at speeds more than double that of conventional ballast cleaning machines.

While I have shown my invention in but one form, it will be obvious to those skilled in the art that it is not so limited, but is susceptible of various changes and modifications without departing from the spirit thereof.

What I claim is:

1. Method of reconditioning ballast along a railroad track bed utilizing means for removing ballast from the shoulder of said track bed, means for removing ballast from beneath said track, and means for recovering reuseable ballast all supported sequentially on a movable frame, comprising the steps of:

(a) removing ballast from the shoulder of said track as said frame moves along said track;
(b) conveying said ballast from the shoulder rearwardly along said frame;
(c) removing ballast from beneath said track rearwardly of said means for removing ballast from the shoulder of said track;
(d) conveying said ballast from beneath the track to said means for recovering ballast;
(e) depositing said ballast from the shoulder of said track beneath the center of said track rearwardly of said means for removing ballast from beneath said track; and
(f) depositing ballast recovered by said means for recovering beneath said track along the shoulder thereof.

2. The method as defined in claim 1 further comprising cleaning the ballast along the shoulders of said track and returning said ballast to said shoulder prior to removing said ballast and conveying said ballast rearwardly.

3. The method as defined in claim 1 further comprising replacing the ballast along the shoulders of said track prior to removing said ballast.

4. A method of reconditioning ballast along a railroad track utilizing forward means for removing ballast along the sides of said track, undercutter means for removing ballast from beneath said track, and recovery means for recovering reuseable ballast from said removed ballast, with said forward means, undercutter means and recovery means being sequentially mounted for concomitant motion along said track comprising the steps of:

(a) removing ballast along the sides of said track and discharging said ballast along the center of said track rearwardly of said undercutter means;
(b) removing ballast from beneath said track with said undercutter means and transferring it to said recovery means; and
(c) discharging reuseable ballast from said recovery means along said track outwardly of the center thereof.

5. The method as defined in claim 4 further comprising replacing the ballast along the sides of said track prior to removing said ballast to the center of said track.

6. Apparatus for reconditioning ballast along a railroad track utilizing a movable frame supported on said track and a cleaner means supported on said frame for recovering reuseable ballast, comprising:

(a) first means supported on said frame for removing ballast from along each shoulder of the track bed of said track;
(b) undercutter means supported on said frame rearwardly of said first means and forwardly of said cleaner means for removing ballast from beneath said track;
(c) by-pass means supported on said frame for conveying ballast from said first means rearwardly of said undercutter means and depositing said ballast beneath said track along the center thereof;
(d) conveyor means for conveying ballast from said undercutter means to said cleaner means; and
(e) discharge means associated with said cleaner means for directing ballast recovered thereby to said track adjacent and along each shoulder of said track.

7. Apparatus as defined in claim 6 wherein said first means comprises:

(a) excavating wheels supported for driven rotation on said frame on each side of said track; and
(b) means for conveying said ballast from said wheels to said by-pass means.

8. Apparatus as defined in claim 7 wherein said by-pass means comprises:

(a) a first horizontal conveyor extending along said frame from said first means and positioned to convey ballast therefrom to a point intermediate said first means and said undercutter means; and
(b) a second horizontal conveyor extending along said frame and positioned to convey ballast received from said first horizontal conveyor to a point intermediate said undercutter means and said cleaner means and positioned to discharge said ballast along the center of said track.

9. Apparatus for reconditioning ballast along a railroad track comprising:

(a) forward means for removing ballast from adjacent the sides of said track;

(b) undercutter means, located rearwardly of and in fixed relation to said forward means, for removing ballast from beneath said track;

(c) by-pass means positioned to receive ballast from said forward means for conveying said ballast rearwardly of said undercutter means and discharging said ballast along the center of said track; and (d) means positioned to receive ballast from said undercutter means for recovering reuseable ballast therefrom and discharging said reuseable ballast along said track outwardly of the center thereof.

10. Apparatus as defined in claim 9 wherein said forward means comprises a ditcher wheel assembly including a ditcher wheel supported for rotation on each side of said track and a horizontal cross conveyor associated with each ditcher wheel and positioned to receive ballast therefrom and to discharge said ballast proximal the center of said track.

11. Apparatus as defined in claim 10 wherein said by-pass means comprises:

(a) a forward conveyor extending parallel to said track and positioned to receive ballast from said forward means; and (b) a discharge conveyor extending parallel to said track positioned to receive ballast from said forward conveyor and to discharge said ballast along the center of said track rearwardly of said undercutter means.

12. Apparatus as defined in claim 9 wherein said by-pass means comprises:

(a) a forward conveyor extending parallel to said track and positioned to receive ballast from said forward means; and (b) a discharge conveyor extending parallel to said track positioned to receive ballast from said forward conveyor and to discharge said ballast along the center of said track rearwardly of said undercutter means.

13. Apparatus as defined in claim 12 wherein said means for recovering ballast comprises:

(a) a cleaning screen;

(b) a conveyor positioned to receive ballast from said undercutter and to discharge said ballast into said cleaning screen; and (c) discharge means associated with said cleaning screen for discharging reuseable ballast along said track outwardly of the center thereof.

14. Apparatus as defined in claim 9 further comprising frame means supporting said forward means, said undercutter means, said by-pass means, and said means for recovering for concommitant motion thereof along said railroad track.

* * * * *